United States Patent [19]

Morris et al.

[11] 4,043,356

[45] Aug. 23, 1977

[54] INFLATING PROBE

[75] Inventors: Ralph Morris, Clontarf; William Gordon Turner, Balgowlah, both of Australia

[73] Assignee: Morris Turner Pty. Limited, Balgowlah, Australia

[21] Appl. No.: 706,788

[22] Filed: July 19, 1976

[30] Foreign Application Priority Data

Aug. 20, 1975 Australia ..... 2870/75
Apr. 27, 1976 Australia ..... 13404/76

[51] Int. Cl.[2] ..... F16K 43/00

[52] U.S. Cl. ..... 137/320; 137/318; 137/533.11; 137/223; 128/232; 141/392

[58] Field of Search ..... 128/239, 231, 232; 141/392, 329, 330; 137/223, 315, 318, 519.5, 533.11, 320

[56] References Cited

U.S. PATENT DOCUMENTS

| | | | |
|---|---|---|---|
| 758,643 | 5/1904 | Haigh | 128/232 |
| 1,930,182 | 10/1933 | Richardson | 137/318 X |
| 2,617,624 | 11/1952 | Annis | 137/533.11 X |
| 3,849,072 | 11/1974 | Ayres | 137/533.11 X |

*Primary Examiner*—Harold W. Weakley
*Attorney, Agent, or Firm*—Edward C. Threedy

[57] ABSTRACT

An inflator probe for filling gas containers and the like comprising a one-piece body molded from suitable plastic material and providing a cylindrical externally threaded end piece for attachment to a pump followed by an enlarged-diameter shoulder with an elongated tapered nozzle extending therefrom insertable into the inflatable container, an internal center bore commencing at the threaded end reduced to form a circular ridge acting as a seat for a ball positioned in a chamber formed in the end piece, the ball sealing against back flow of gas between strokes of the pump, a non-circular restricted throat providing communication between the chamber and the bore for the flow of gas forced by the pump toward the nozzle outlet but restraining passage of the ball through the bore, the molding material being sufficient resilient to permit insertion and retention of the ball within the chamber after molding and including therein a lubricant for assisting easy entry of the nozzle into the inflatable container.

4 Claims, 2 Drawing Figures

INFLATING PROBE

SUMMARY OF THE INVENTION

Figure 1:
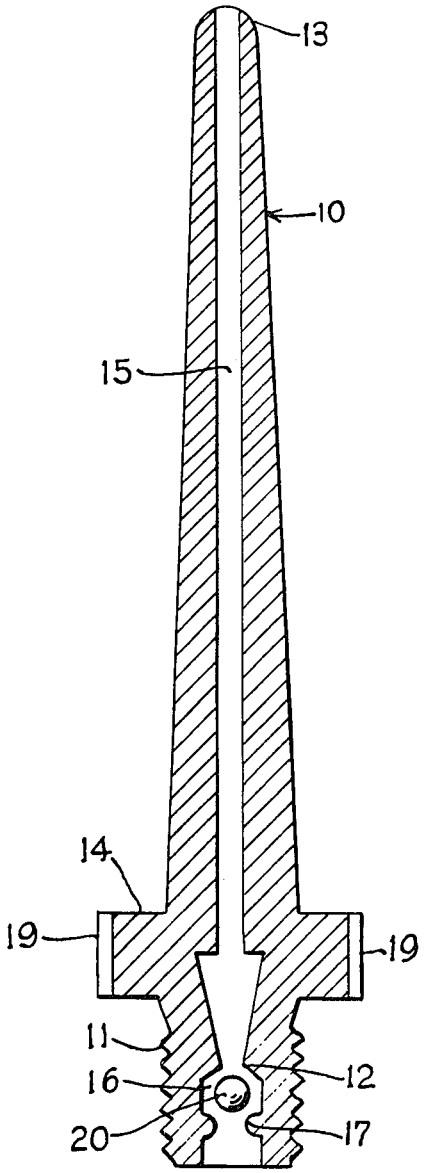

The present invention relates to an inflating probe for filling gas-filled containers and may be usefully applied to the inflation of bladders of all kinds and in particular the bladders in sports balls such as soccer balls, rugby balls, basket balls and the like.

A means for injecting air into the container or bladders and holding it there by means of a non-return valve is necessary if the bladder or other container is to remain properly and usefully inflated. Hitherto it has been customary to have a hole in the bladder and to insert therein a non-return rubber bung which comprises a resilient rubber plate-like member having an axial bung extending on either side thereof. One end of the bung is solid rubber and is surrounded by a circumferential sealing ring and this end is inserted through the hole in the bladder and the flat plate-like member is glued to the external face of the bladder by a suitable adhesive. The other end of the bung, that is, that end which projects from the external face of the plate and the bladder, has a hole extending through the bung. When it is desired to inflate the bladder, hitherto it has been customary to insert a fine metal, needle-like nozzle through the axial hole, pushing the nozzle hard so that it penetrates through the compressed hole in the bung into the bladder chamber. Once through the bung, air is then pumped through the fine nozzle into the bladder and when the bladder is fully inflated the nozzle is withdrawn and the pressure of the circumferential sealing ring compresses the channel in the bung to close over the fine hole made by the needle-like nozzle to seal the air in the bladder.

Apart from the fact that these metal nozzles were relatively difficult and expensive to manufacture and to buy, one problem with them was that it was difficult to direct the path of the nozzle through the bung with accuracy and often the nozzle punctured the circumferential sealing ring thereby destroying its efficiency and allowing air to leak out of the bladder.

One of the objects of the present invention is to avoid the above-stated disadvantages and to provide an inflating probe moulded in a single piece which is cheaper to manufacture and to purchase and which is safer and surer in action than hitherto known probes and which can be pushed through a bladder bung without destroying the seal. It will be appreciated however that the use of the invention need not be confined to cooperation with the form of seal just described and can have other applications.

Desirably the probe is moulded from polypropylene or nylon but other moulding materials will be suitable provided they are sufficiently resilient to allow the extraction of the moulding spigot and the insertion of a sealing ball without deformation from the originally moulded shape, and are of sufficient rigidity to allow the tapered probe nozzle to be thrust through or into the material past which the gas or air must be fed. The only additional component is the steel ball referred to later which can have a diameter of about 2 millimeters although this can be a matter for choice. The material from which the probe is moulded can have a lubricant mixed with it prior to moulding so that in frictional circumstances it will provide self-lubrication. A suitable additive is 5% of pure parrafin oil to 95% of polypropylene.

Figure 2:
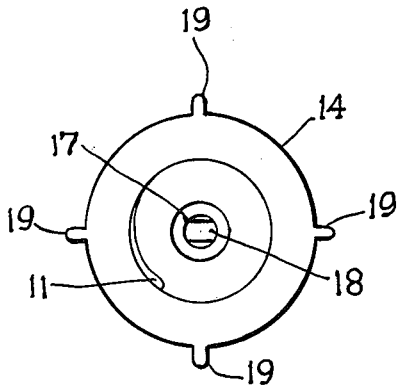

The invention will now be described with reference to the accompanying drawings in which FIG. 1 is a longitudinal section of the probe according to the invention; and FIG. 2 is a view from the threaded end of the probe with the ball removed.

Referring now to the drawings, the probe 10 has a cylindrical externally threaded end piece 11, an elongated tapered probe end 13, an abutment shoulder 14, and a bore 15 extending coaxially from one end of the probe to the other.

A non-return ball valve chamber 16 containing a ball 20 has a valve seat in the form of a circular ridge or collar 17 and a throat 12 at the other end to serve as a barrier to impede the passage of the ball down the bore 15 when gas is being forced into the container. This barrier is non-circular so that it will not act in cooperation with the ball as a seal and it will be obvious that a variety of configurations will fulfill this requirement such as oval, rectangular, star-shaped etc. forms. Finger grips 19 may be provided if desired on the shoulder 14 to assist in the rotation of the probe when connecting it to the pump by the threaded end piece 11. As previously indicated the steel ball 20 is forced past the internal circular ridge or collar into the valve chamber 16 where it is retained due to the resilient nature of the moulding material.

To use the probe on a bladder closure of the type previously described the threaded end 11 of the probe 10 is threaded onto a convenient pump such as a bicycle pump, and the probe end 13 is pushed through the hole in the rubber bung of a bladder which protrudes through the laced or otherwise closed portion of the wall of a soccer ball or the like. Once the probe is right through the rubber bung, air or gas is pumped into the bladder from the pump and when inflated the probe is withdrawn from the bladder and the ball is laced up or otherwise closed. The air from the pump forces the steel ball valve 20, away from the ridge or collar seat 17 and up against the narrow throat 12 of the chamber 16. However the provision of air passages 18 around the ball 20 at the throat 12 allows the gas or air to escape from the valve chamber 16 into the bore 15 and out into the container or bladder to be filled. In the interval between the strokes of the pump the steel ball returns to the seat provided by the ridge or collar 17 and restricts the escape of air or gas from the container or bladder since the pressure is not sufficient to force the ball past the seat 17. It will be appreciated from the foregoing description that it was necessary to design the internal configuration to overcome problems associated with a single piece moulding.

Having thus described our invention, what we claim as new and desire to protect by Letters Patent is:

1. An inflator probe for filling gas containers and the like comprising a. a one-piece body molded from a suitable plastic material, b. said body providing a circumferentially extending shoulder having on one side an externally threaded cylindrical end piece for attachment to a pump, c. an elongated probe extending from the other side of said shoulder tapered in the direction of its length and providing a center bore therethrough, d. a chamber formed in and opening out of said cylindrical end piece, e. a ball valve within said chamber having a diameter less than that of said chamber, f. a non-circular restricted throat providing communication between said chamber and said center bore of said probe and of a size less than the diameter of said ball valve, and g. an internal collar within said chamber between said open end thereof and said restricted throat forming a seat for said ball valve, h. said collar having sufficient resiliency to permit insertion and retention of said ball valve in said chamber after said probe has been molded.

2. An inflator probe as defined in claim 1 in which finger grips are provided on the shoulder to facilitate rotation of the probe.

3. An inflator probe as defined in claim 1 which has a lubricant included in the molding material to provide a slippery surface so as to assist the entry of the probe into a seal, bung or orifice through which the inflating gas is to be fed into the container.

4. An inflator probe as defined in claim 3 in which finger grips are provided on the shoulder to facilitate rotation of the probe.

* * * * *